US008365835B2

(12) United States Patent
Loughlin

(10) Patent No.: US 8,365,835 B2
(45) Date of Patent: Feb. 5, 2013

(54) METHOD AND DOWNHOLE TOOL ACTUATOR

(75) Inventor: Michael J. Loughlin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 130 days.

(21) Appl. No.: 12/175,073

(22) Filed: Jul. 17, 2008

(65) Prior Publication Data

US 2010/0012314 A1 Jan. 21, 2010

(51) Int. Cl.
*E21B 33/12* (2006.01)

(52) U.S. Cl. ..... 166/387; 166/187

(58) Field of Classification Search ..... 166/187, 166/387

See application file for complete search history.

(56) References Cited

U.S. PATENT DOCUMENTS

| | | | | |
|---|---|---|---|---|
| 2,516,580 | A * | 7/1950 | Lynes | 166/141 |
| 2,942,666 | A * | 6/1960 | Boer et al. | 166/135 |
| 3,422,673 | A * | 1/1969 | Lebourg | 73/152.53 |
| 3,460,624 | A * | 8/1969 | Droulers et al. | 166/285 |
| 5,109,925 | A * | 5/1992 | Stepp et al. | 166/184 |
| 5,297,633 | A | 3/1994 | Snider et al. | |
| 5,782,306 | A * | 7/1998 | Serafin | 166/387 |
| 5,988,287 | A | 11/1999 | Jordan, Jr. et al. | |
| 6,834,725 | B2 | 12/2004 | Whanger et al. | |
| 7,617,880 | B2 * | 11/2009 | Loughlin | 166/387 |
| 2007/0107913 | A1 | 5/2007 | Arnold et al. | |
| 2009/0255691 | A1 * | 10/2009 | Loughlin et al. | 166/387 |

OTHER PUBLICATIONS

Schlumberger, Mechanical Disconnect, CoilTOOLS Catalog, Copyright 2008, 2 pages, Retrieved online on Oct. 2, 2008 from: http://www.slb.com/media/services/coiled/tools/mechanicaldisconnect.pdf.

TAM, Single Set Inflatable Retrievable Packers, TAM International, Copyright 2003. 8 pages, Retrieved online on Oct. 2, 2008 from: http://www.tamintl.com/images/stories/pdfs/Single_Set_Brochure.pdf.

Afghoul, A.C., et al. "Coiled Tubing: The Next Generation," Oilfield Review, pp. 38-57, Spring 2004, 20 pages.

Rowe, Clem, "The Inflatable Packer—A Most Versatile Tool," Drill 2001 Conference Proceedings, Oct. 2001, 8 pages.

* cited by examiner

*Primary Examiner* — David Andrews
*Assistant Examiner* — Catherine Loikith
(74) *Attorney, Agent, or Firm* — Cantor Colburn LLP

(57) ABSTRACT

A downhole tool actuator includes, an inflatable member, a first portion on an uphole end of the inflatable member that is attachable to a first structure of a downhole tool, and a second portion on a downhole end of the inflatable member that is attachable to a second structure of the downhole tool. The actuator configured so that the second structure is movable relative to the first structure in response to movement of the second portion relative to the first portion in response to inflation of the inflatable member.

18 Claims, 4 Drawing Sheets

METHOD AND DOWNHOLE TOOL ACTUATOR

BACKGROUND

A variety of actuators are used in the hydrocarbon recovery industry to actuate downhole tools, such as bridge plugs, for example. Bridge plugs include, among other things, seals and anchors. In addition to actuating the seals and the anchors the actuator typically also controls the timing of actuation of the seal with respect to the anchors. Many actuators have complex and expensive mechanisms that are large and heavy and have multiple modes of failure. As such, the industry is always receptive to new and simple actuators.

BRIEF DESCRIPTION OF THE INVENTION

Disclosed herein is a downhole tool actuator. The actuator includes, an inflatable member, a first portion on an uphole end of the inflatable member that is attachable to a first structure of a downhole tool, and a second portion on a downhole end of the inflatable member that is attachable to a second structure of the downhole tool. The actuator configured so that the second structure is movable relative to the first structure in response to movement of the second portion relative to the first portion in response to inflation of the inflatable member.

Further disclosed herein is a method of actuating a downhole tool. The method includes, attaching a first structure of the downhole tool to a first portion of an inflatable member, movably engaging a second structure of the downhole tool to a second portion of the inflatable member, and inflating the inflatable member thereby moving the second portion relative to the first portion and the second structure relative to the first structure to actuate the downhole tool.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Figure 1A:
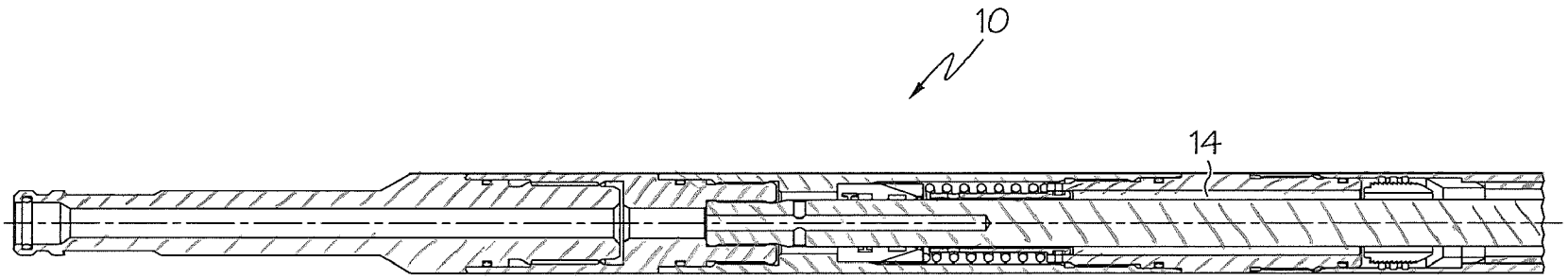
FIGS. 1A-1D depict a partial cross sectional side view of a downhole tool actuator disclosed herein in operable communication with a downhole tool in a nonactuated condition.
Figure 2A:
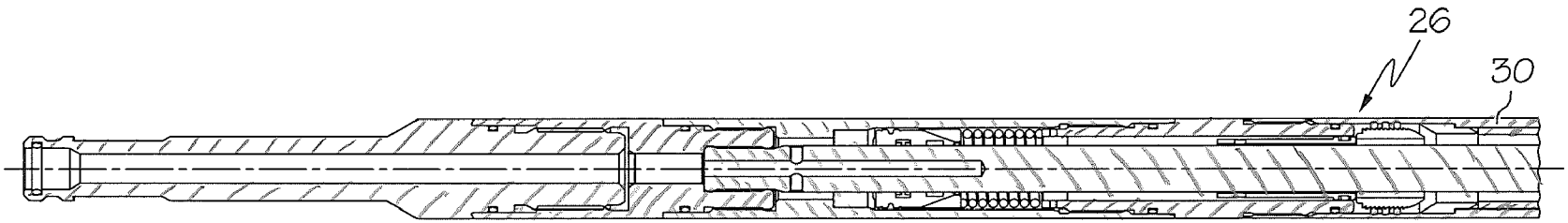
FIGS. 2A-2D depict a partial cross sectional side view of the downhole tool actuator and downhole tool of FIGS. 1A-1D illustrated in an actuated condition.
Figure 1B:
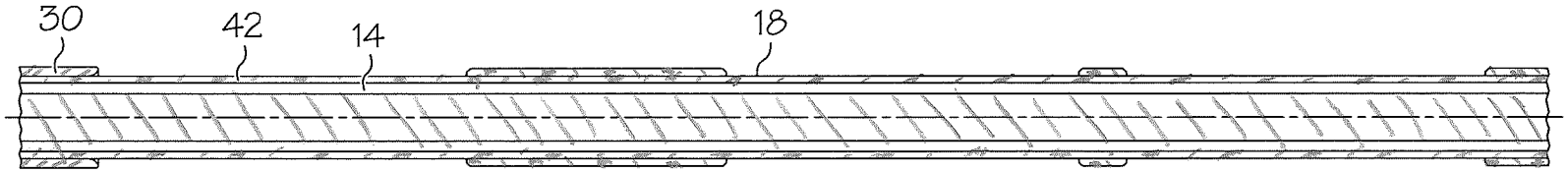
Figure 2B:
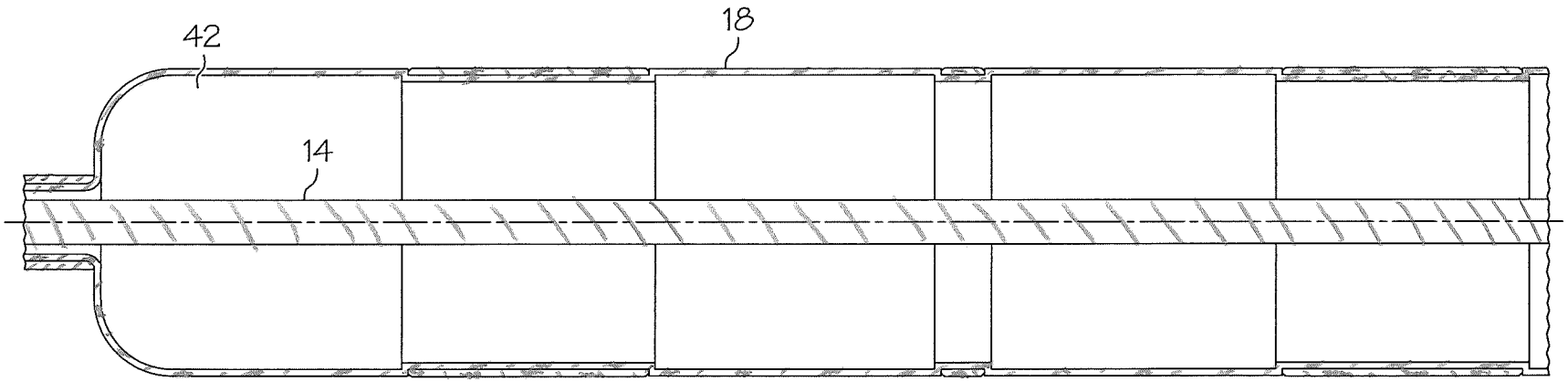
Figure 1C:
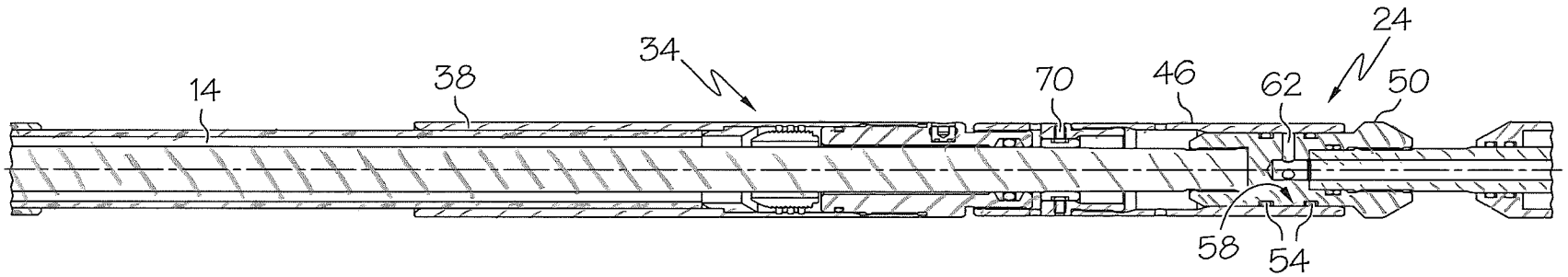
Figure 2C:
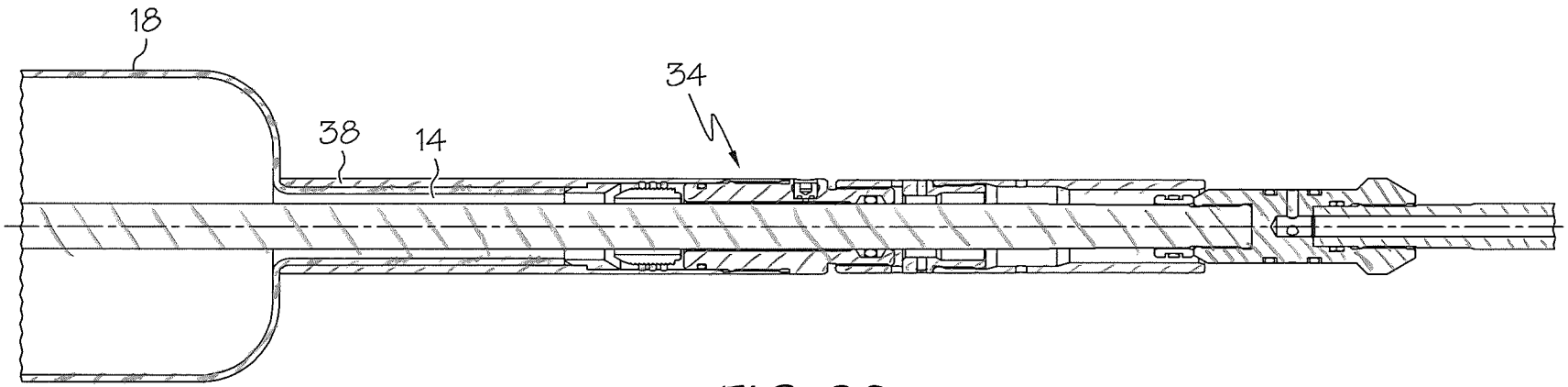

A detailed description of one or more embodiments of the disclosed apparatus and method are presented herein by way of exemplification and not limitation with reference to the Figures.

Referring to FIGS. 1A-2D, an embodiment of a downhole tool actuator disclosed herein is shown generally at 10. The actuator 10 among other things includes, a mandrel 14 and an inflatable member 18, illustrated herein as an inflatable seal. The inflatable member 18 is constructed such that during inflation thereof the inflatable member 18 expands radially outwardly while simultaneously axially contracting. In order to facilitate the relationship between axial contraction and radial expansion, of the inflatable member 18, it may be advantageous to construct the inflatable member 18 such that the elasticity is nonhomogeneous. More specifically, by allowing a circumference of the inflatable member 18 to increase at lower levels of stress in comparison to an axial dimension thereof, as the inflatable member 18 expands radially it will contract axially. Such a structure of the inflatable member 18 might include axially oriented fibers that have a high tensile strength, such as, carbon composite materials or metal, for example, within an elastomeric body. The actuator 10 is in operable communication with a downhole tool 22, shown in this embodiment as an anchor having a valve 24. The downhole tool 22 is engaged with both the mandrel 14 and the inflatable member 18 as follows. A first sub assembly 26, adjacent and uphole of the inflatable member 18 in this embodiment, is attached to the mandrel 14 and a first portion 30 of the inflatable member 18. Similarly, a second sub assembly 34, adjacent and downhole of the inflatable member 18, is slidably engaged about the mandrel 14 and is attached to a second portion 38 of the inflatable member 18. The inflatable member 18, in one embodiment, being made of mostly an elastomeric material, deforms elastically as pressurized fluid flows into an internal chamber 42 defined by an annular space between the inflatable member 18 and the mandrel 14. The inflation deformation, as described above, causes the inflatable member 18 to radially expand while simultaneously axially contracting, thereby drawing the first portion 30 closer to the second portion 38. This axial drawing action of the inflatable member 18, in relation to the stiff and unyielding length of the mandrel 14, is the action that drives the actuator 10 disclosed herein.

In the embodiment detailed herein the actuator 10 is illustrated actuating the valve 24 as follows. Since the first sub assembly 26, in this embodiment, fixedly attaches the first portion 30 of the inflatable member 18 to the mandrel 14, relative motion therebetween is prevented. As such, in response to axial contraction of the inflatable member 18, during inflation thereof, the second portion 38 moves relative to the mandrel 14. The second sub assembly 34, therefore, being attached to the second portion 38, moves in relation to the mandrel 14 as well. A housing 46 of the valve 24 being attached to the second sub assembly 34, and a valve body 50 of the valve 24 being attached to the mandrel 14, results in movement of the valve body 50 relative to the housing 46 in response to inflation of the inflatable member 18. This relative motion between the valve body 50 and the housing 46 actuates the valve 24. Additionally, the valve 24 includes two o-rings 54 sealingly engaged between the valve body 50 and an internal surface 58 of the housing 46. The two o-rings 54 straddle a port 62 that is fluidically connected to a piston 66 of the anchor 22. The port 62 is, therefore, sealed from wellbore fluid until actuation of the valve 24. Upon actuation of the valve 24, the port 62 is opened to wellbore fluid and the hydrostatic pressure associated therewith. The hydrostatic pressure, being supplied to the piston 66 in response to the opening of the valve 24, actuates the anchor 22 as will be described with reference to FIGS. 1D and 2D below.

A force-releasing member 70, illustrated herein as shear screws, positionally locks the mandrel 14 to the second sub assembly 34 until a selected force threshold is reached. This force-releasing member 70 thereby prevents inadvertent actuation of the valve 24, and consequently inadvertent actuation of the anchor 22. Additionally, the force-releasing member 70 holds the inflatable member 18 in an elongated position, where the elastomeric portion is less likely to be swabbed off, during running of the actuator 10. The selected force threshold of the force-releasing member 70 is set to be greater than forces expected to be encountered during running of the actuator 10 into the well but less than forces achievable by contraction of the inflatable member 18 during inflation thereof.

Figure 1D:
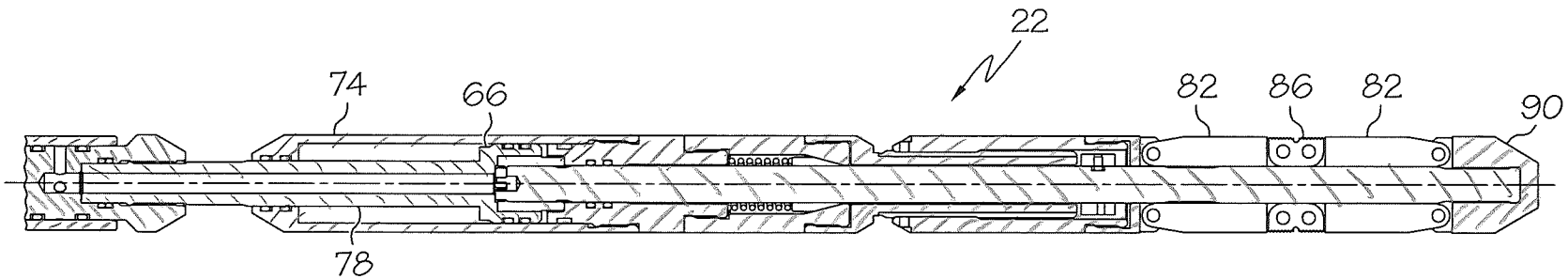
Figure 2D:
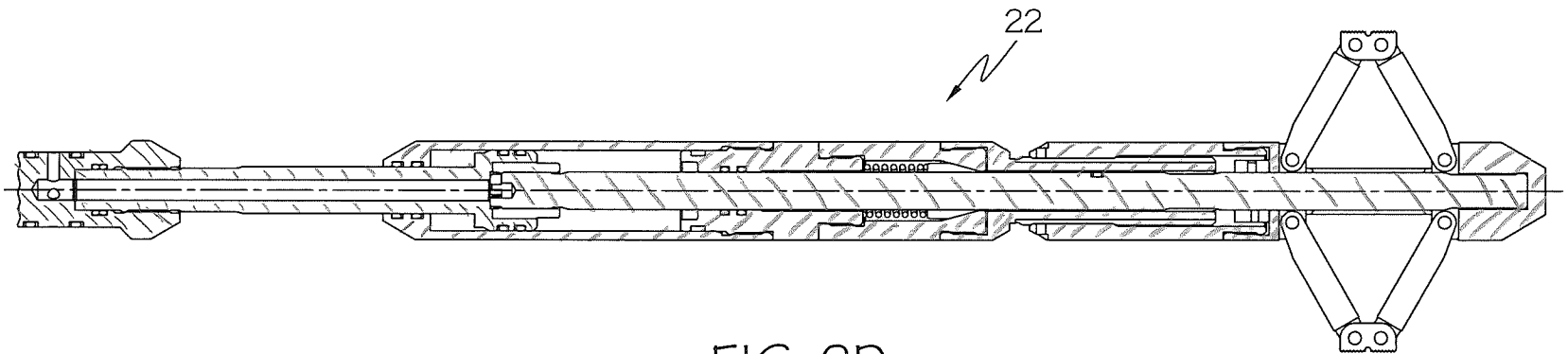

Referring specifically to FIGS. 1D and 2D, the anchor 22 includes, the piston 66, a piston housing 74, a mandrel 78 and support links 82, connected to slips 86. In response to opening of the valve 24, fluid under hydrostatic pressure applies force to the piston 66 and to the piston housing 74, within which the piston 66 is housed. The force of the pressure causes the piston housing 74 to move relative to the piston 66 Such relative motion causes the support links 82, pivotally connecting the slips 86 between the piston housing 74 and a connector 90 attached to the end of the mandrel 78, to pivotally extend the slips 86 radially outwardly. The radial outward movement of the slips 86 allows the slips 86 to engage with a wall of a casing, liner, or other downhole structure (not shown) within which the anchor 22 is positioned to positionally fix the anchor 22 thereto.

Although in the embodiment disclosed herein the actuator 10 is shown actuating the valve 24, it should be noted that, in alternate embodiments, the actuator 10 could be coupled directly to the anchor 22 thereby negating the need for the valve 24 completely. In such an embodiment the piston housing 74 would be attached to the second sub assembly 34 and the mandrel 78 would be attached to the mandrel 14. Then, upon axial contraction of the inflatable member 18, the piston housing 74 would move leftward (as viewed in the figures) while the mandrels 14, 78 would remain stationary, thereby causing the support links 82 to pivot radially outwardly as described above.

In some applications, it may be desirable to set the anchor 22 just prior to sealing the wellbore with the inflatable member 18. Such a sequence will allow the set anchor 22 to prevent movement of the tool 10 relative to the downhole structure during the setting and sealing of the inflatable member 18. Embodiments disclosed herein facilitate such sequential timing. Controlling a rate at which fluid flows into the inflatable member 18 allows an operator to control the rate of filling of the inflatable member 18 and the resulting rate of inflation. The source of fluid to fill the inflatable member 18 can vary, for example, the fluid can be supplied from surface or from downhole locations as best suits each particular application. Additionally, the valve 24 can be configured to open after inflation begins but prior to sealing of the inflatable member 18 with the wellbore. As such, the anchor 22 can be completely set prior to completing the setting of the inflatable member 18.

In addition to controlling the setting sequence of the inflatable member 18 relative to the anchor 22, embodiments disclosed herein allow the anchor 22 to be located below the seal as is commonly preferred. And, unlike typical arrangements, that require the existence of an axial channel or port through the inflatable member 18, to the tool positioned therebelow to provide a means of actuation of the tool, the embodiments disclosed herein require no such channel or port. The absence of a need for such a channel or port allows the mandrel 14 to be solid and stronger, thereby having fewer propensities to failure, as well as being simpler, smaller and less expensive to produce. Optionally, applications may include a channel or port through the inflatable member 18 to accommodate means for actuating, communicating or flowing therethrough.

Although embodiments described herein have used the actuator 10 to actuate the valve 24 and the anchor 22, it should be noted that any downhole tool could be actuated by the relative motion that the disclosed actuator 10 provides between the second portion 38 and the first portion 30. It should also be noted that actuation forces and relative motion displacements can be altered, as desired per application, through changes in the geometric design of the inflatable member 18, the portions 30, 38 and the mandrel 14, for example.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole tool actuator, comprising:

an inflatable member;

a first portion of the inflatable member on an uphole end thereof being attachable to a first structure of a downhole tool;

a second portion of the inflatable member on a downhole end thereof being attachable to a second structure of the downhole tool such that inflation of the inflatable member causes the first portion to move relative to the second portion thereby causing movement of the first structure relative to the second structure and actuation of the downhole tool; and a support extending at least from the first portion to the second portion providing support thereto and being devoid of any ports or channels extending axially therethrough between the first portion and the second portion.

2. The downhole tool actuator of claim 1, wherein the inflatable member is sealable to a downhole structure positioned therearound in response to being in an inflated condition.

3. The downhole tool actuator of claim 1, wherein the support is a mandrel fixedly attached to the first portion and slidably engaged with the second portion, the first portion being attachable with the downhole tool through the mandrel.

4. The downhole tool actuator of claim 1, wherein the inflatable member is configured to be inflated without fluid communication thereto through any ports or channels formed axially through the support between the first portion and the second portion.

5. The downhole tool actuator of claim 1, further comprising at least one force releasing member in operable communication with the first portion and the second portion, the at least one force releasing member being releasable in response to forces generated in the downhole tool actuator during inflation of the inflatable member.

6. The downhole tool actuator of claim 1, wherein the movement of the second portion towards the first portion is along a longitudinal axis of the downhole tool actuator.

7. The downhole tool actuator of claim 1, wherein the downhole tool, in operable communication with the downhole tool actuator, is positionable downhole of the downhole tool actuator.

8. The downhole tool actuator of claim 1, wherein the inflatable member is inflatable with fluid supplied from downhole.

9. The downhole tool actuator of claim 1, wherein an inflatable portion of the inflatable member is elastomeric.

10. A method of actuating a downhole tool, comprising;

attaching a first structure of the downhole tool to a first portion of an inflatable member;

attaching a second structure of the downhole tool to a second portion of the inflatable member;

inflating the inflatable member thereby moving the second portion relative to the first portion and the second structure relative to the first structure;

actuating the downhole tool with the movement of the first structure relative to the second structure; and providing a solid support extending longitudinally between at least the first portion and the second portion by excluding any ports or channels formed axially therethrough between the first portion and the second portion.

11. The method of actuating a downhole tool of claim 10, further comprising inflating the inflatable member with fluid from downhole.

12. The method of actuating a downhole tool of claim 10, wherein the movement of the second portion relative to the first portion is toward the first portion.

13. The method of actuating a downhole tool of claim 10, further comprising opening a valve with the movement of the second structure relative to the first structure.

14. The method of actuating a downhole tool of claim 10, further comprising setting slips of an anchor with the movement of the second structure relative to the first structure.

15. The method of actuating a downhole tool of claim 10, further comprising radially expanding the inflatable member.

16. The method of actuating a downhole tool of claim 10, further comprising preventing longitudinal fluidic communication through the support extending longitudinally between the first portion and the second portion by voiding the support of any ports or channels formed therein at least between the first portion and the second portion.

17. The method of actuating a downhole tool of claim 10, further comprising sealing the inflatable member to a downhole structure.

18. The method of actuating a downhole tool of claim 17, further comprising sizing the inflatable member to release a force-releasing member prior to sealing the inflatable member with the downhole structure.

* * * * *